US007504913B2

(12) United States Patent
Yoon et al.

(10) Patent No.: US 7,504,913 B2
(45) **Date of Patent: *Mar. 17, 2009**

(54) DC BLOCK WITH BAND-NOTCH CHARACTERISTIC USING DGS

(75) Inventors: Ick-Jae Yoon, Seoul (KR); SeongSoo Lee, Suwon-si (KR); Young Joong Yoon, Seoul (KR); Young-Hwan Kim, Hwaseong-si (KR); Young-Eil Kim, Suwong-si (KR); Hyungrak Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 265 days.

This patent is subject to a terminal disclaimer.

(21) Appl. No.: 11/477,625

(22) Filed: Jun. 30, 2006

(65) Prior Publication Data

US 2007/0194864 A1 Aug. 23, 2007

(30) Foreign Application Priority Data

Feb. 3, 2006 (KR) ..... 10-2006-0010864

(51) Int. Cl.
*H01P 3/08* (2006.01)

(52) U.S. Cl. ..... 333/246; 333/204; 333/245

(58) Field of Classification Search ..... 333/202, 333/204, 245–246

See application file for complete search history.

(56) References Cited

U.S. PATENT DOCUMENTS

2007/0052492 A1* 3/2007 Duan et al. ..... 333/33
2007/0069833 A1* 3/2007 Serban ..... 333/34

OTHER PUBLICATIONS

UWB RF Receiver Front-End With Band Notch Characteristic of 5 GHz WLAN A Master Thesis submitted to the Department the Electrical & Electronic Engineering and the Graduate School of Yonsei University in partial fulfillment of the requirements for the degree of Master of Science Ick-Jae Yoon Jun. 2005.

* cited by examiner

*Primary Examiner*—Anh Q Tran
(74) *Attorney, Agent, or Firm*—Sughrue Mion, PLLC

(57) ABSTRACT

A DC block with a band-notch characteristic using a defected ground structure (DGS), includes a pair of coupled lines for being formed parallel to each other on one surface of a dielectric and blocking a flow of a DC, and at least one DGS for being formed on an area of the rear surface of the dielectric corresponding to each coupled line and comprising an etched region formed by etching a part of a ground surface bonded to the dielectric and a metal region formed in the etched region. Accordingly, the stop band of the desired bandwidth in the desired communications band can be formed and the size of the communications system can be reduced.

13 Claims, 3 Drawing Sheets

DC BLOCK WITH BAND-NOTCH CHARACTERISTIC USING DGS

CROSS-REFERENCE TO RELATED APPLICATIONS

This application claims priority from Korean Patent Application No. 10-2006-0010864, filed Feb. 3, 2006 in the Korean Intellectual Property Office, the entire contents of which are incorporated herein by reference.

BACKGROUND OF THE INVENTION

1. Field of the Invention

The present invention relates to a direct current (DC) block with a band-notch characteristic using a DGS. More particularly, the present invention relates to a DC block with a band-notch characteristic using a defected ground structure (DGS) to superiorly block a certain frequency band in the UWB.

2. Description of the Related Art

In general, the ultra wideband (UWB) communications can perform high-speed data transmission in a very wide frequency band with a very low power. The frequency band used for the UWB communications is 3.1~10.6 GHz, and 5.15~5.825 GHz of that range is used for HIPERLAN/2 or Institute of Electrical and Electronics Engineers (IEEE) 802.11a, wireless local area network (WLAN) standards. The power used in the WLAN band is 70 dB higher than that in the UWB. Accordingly, a UWB communication signal in a WLAN frequency band can be subjected to interference so that methods of removing signals of the WLAN frequency band among the UWB communication signals have been suggested.

A primary method applies a band stop filter (BSF) at the end of the radio frequency (RF) communications system. However, as a result of using the BSF, the communications system decreases in efficiency and increases in size.

Meanwhile, an active circuit is usually a circuit including a nonlinear element such as the field effect transistor (FET), bipolar junction transistor (BJT) and diode. There are active circuits such as an amplifier, oscillator, mixer, frequency doubler and phase shifter.

In order to use the active circuit in the RF communications system, a DC block which keeps a signal line transmitting signals in the system and the active circuit from being directly connected with each other is needed.

The DC block keeps a DC power from flowing in an RF signal line and having influence on RF signals, and conventionally, a capacitor has been mainly used for the DC block. However, if the capacitor is used in the super high frequency and ultra wideband system such as the UWB system, self-resonance or undesired parasitic components may sometimes occur. Accordingly, features of the capacitor are not guaranteed, efficiency of the capacitor decreases and the cost increases.

To solve the problems, a DC block using micro strip lines has been suggested. The DC block is formed with a pair of micro strip lines parallel to each other, and both ends of each micro strip line are electrically cut off so that it can function as a DC open circuit.

A configuration has been suggested to use as a low pass filter (LPF) by applying a DGS to the DC block using the micro strip lines.

Usually, the DGS is a structure with an etched defect pattern on a ground surface of a transmission line, so that a slow wave of small loss and a stop band in a certain frequency band can be formed. In addition, the DGS effectively increases the capacitance and inductance of the transmission line and has features of the LPF with one pole. Accordingly, the DGS is conventionally used as the LPF or the band pass filter (BPF).

As described above, when the DGS is used in the DC block, if the DGS is used as the LPF or BPF, the DGS can also be used as the BSF. However, until now such application has not been tried, and the DGS has to be modified in order to use the DC block with the DGS as the BSF. Accordingly, a method of forming a band-notch of a desired bandwidth in a desired frequency band has to be studied by applying the DC block with the modified DGS to the RF system.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

The present invention provides a DC block with a band-notch feature using the DGS to block a desired bandwidth in a desired frequency band.

According to an aspect of the present invention, there is provided a direct current (DC) block with a band-notch characteristic using a defected ground structure (DGS), comprising a pair of coupled lines for being formed parallel to each other on one surface of a dielectric and blocking a flow of a DC, and at least one DGS for being formed on an area of the rear surface of the dielectric corresponding to each coupled line, and comprising an etched region formed by etching a part of a ground surface bonded to the dielectric and a metal region formed in the etched region.

A pair of the DGSs may be formed corresponding to a terminating end of each coupled line, and each DGS may be elongated across each coupled line.

The etched region may be formed along a circumference of the metal region.

A bridge of a metal plate may be formed at a certain part of the circumference of the metal region to electrically connect the metal region and the ground surface.

The bridge may be formed in the middle of the length of the DGS.

The bridges of the DGSs may be formed in a mirror image with both bridges facing each other.

The bridge of each DGS is located to correspond to the area where both coupled lines are adjacent to each other.

A distance between both coupled lines may be the same as the width of the bridge.

The length of the etched region along the circumference of the metal region except for the bridge may be $\lambda/2$ of a frequency of a stop band.

The etched region may be formed in at least one of rectangular, square, oval, round, diamond, zigzag and spiral shapes.

The metal region may be formed in the same shape as the etched region within the etched region.

The width and length of the etched region and the metal region are decided by the stop band and the bandwidth.

The metal region may be formed to lean to one side within the etched region so that the width of the etched region on the other side with the bridge is wider.

BRIEF DESCRIPTION OF THE DRAWINGS

The above other aspects of the present invention will become more apparent by describing in detail exemplary embodiments thereof with reference to the attached drawing figures, wherein.

DETAILED DESCRIPTION OF THE EXEMPLARY EMBODIMENTS

Hereinafter, exemplary embodiments of the present invention will be described in detail with reference to the accompanying drawing figures.

Figure 1:
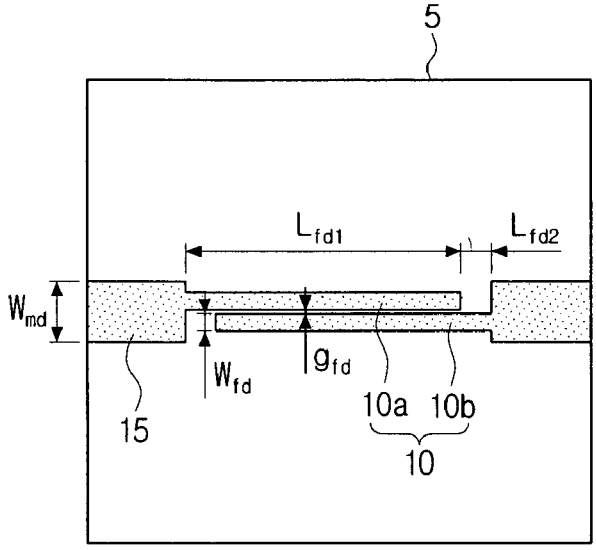
FIG. 1 is a plane view showing coupled lines for a DC block used in a general active circuit according to an exemplary embodiment of the present invention.
Figure 2:
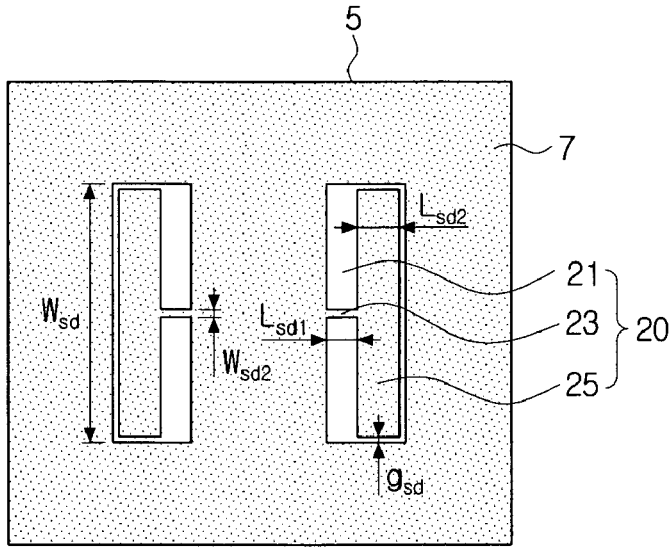
FIG. 2 is a plane view showing a DGS formed corresponding to the coupled lines for a DC block according to an exemplary embodiment of the present invention.

FIG. 1 is a plane view showing coupled lines for a DC block used in a general active circuit according to an exemplary embodiment of the present invention, and FIG. 2 is a plane view showing a DGS formed corresponding to the coupled lines for a DC block according to an exemplary embodiment of the present invention. The coupled lines for a DC block are formed on one surface of a dielectric 5, and the DGS 20 is formed on the rear surface of the dielectric 5.

The coupled lines 10 for a DC block are formed at ends of an active circuit to mutually block a signal line 15 and the active circuit, so that the coupled lines 10 for a DC block can function as an open circuit for the DC. Accordingly, the DC power supplied to the active circuit and the signal transmitted through the signal line 15 can be separated.

Each of the coupled lines 10 is formed of a micro strip line, and the coupled lines 10 includes a first coupled line 10*a* extended from a signal line 15 of an element and a second coupled line 10*b* extended from the active circuit. The first coupled line 10*a* and the second coupled line 10*b* are parallel and separated by a certain space. The length of the first and second coupled lines 10*a* and 10*b* is $\lambda/4$, respectively.

A pair of DGSs 20 are separated by a certain space from each other and formed on a ground surface 7 bonded to the rear surface of the dielectric 5.

Each DGS 20 includes an etched region 21 formed by etching a certain area of the ground surface 7 and a metal region 25 formed in the etched region 21. Accordingly, the etched region 21 is formed in the ring shape along the circumference of the metal region 25.

Each DGS 20 is formed on an area of the rear surface of the dielectric 5, corresponding to the terminating end of each coupled line 10, and is elongated across each coupled line 10.

In FIG. 2, the etched region 21 in each DGS 20 is formed in the rectangular shape and the metal region 25 is formed in the smaller rectangular shape than the etched region 21. However, the etched region 21 can be formed in various forms such as square, oval, round and diamond shapes, and the metal region 25 can also be formed in the same form as that of the etched region 21.

Meanwhile, a bridge 23 is formed on a certain region of the etched region 21 to electrically connect the metal region 25 and the ground surface 7. The bridge 23 and the metal region 25 are formed of the same metal as the ground surface 7. The bridge 23 is formed in the middle of the length of each DGS 20. Both DGSs 20 are formed in a mirror image with both bridges 23 facing each other.

Due to the bridge 23, the etched region 21 is square-ring-shaped with a part open. The length of the etched region 21 along the circumference of the metal region 25 except for the bridge 23 is $\lambda/2$ of the stop band. Accordingly, the length of the etched region 21 of the DGS 20 is the same as the entire length of the conventional DGS. However, the etched region 21 is bent by the metal region 25 so that the real length of the DGS 20 is ½ shorter than that of the conventional DGS.

Meanwhile, in this exemplary embodiment, the metal region 25 is illustrated to be closer to one side within the etched region 21 so that the width of the etched region 21 on the other side with the bridge 23 is wider. However, the stop band and bandwidth can vary according to the width and length of the etched region 21 and metal region 25 so that various designs are acceptable.

Figure 3:
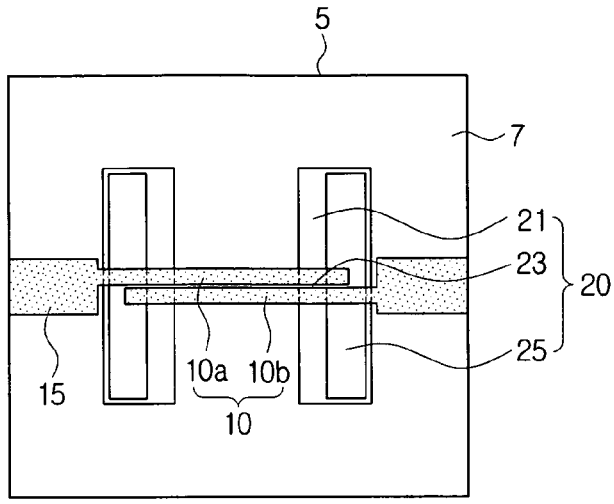
FIG. 3 is a perspective view showing a DC block which has a pair of coupled lines on one surface of a dielectric and a pair of DGSs on the rear surface according to an exemplary embodiment of the present invention.

FIG. 3 is a perspective view showing a DC block which has a pair of coupled lines on one surface of the dielectric 5 and a pair of DGSs on the rear surface.

As shown in FIG. 3, each DGS 20 is formed on an area of the rear surface of the dielectric 5, corresponding to the terminating end of each coupled line 10. Further, the bridge 23 of each DGS 20 is located to correspond to the area where both coupled lines 10 are adjacent to each other.

When the coupled lines 10 for DC block are formed on one surface of the dielectric 5 and DGSs 20 are formed on the rear surface of the dielectric 5, an electromagnetic wave is focused on around the coupled lines 10 and the electromagnetic wave is obstructed by the etched region 21 of the DGS 20, so that multiple interference is caused in the stop band. Accordingly, the effect of propagation delay occurs so that the length of each coupled line 10 can decrease and the distance between both coupled lines 10 can be adjusted.

Figure 4:
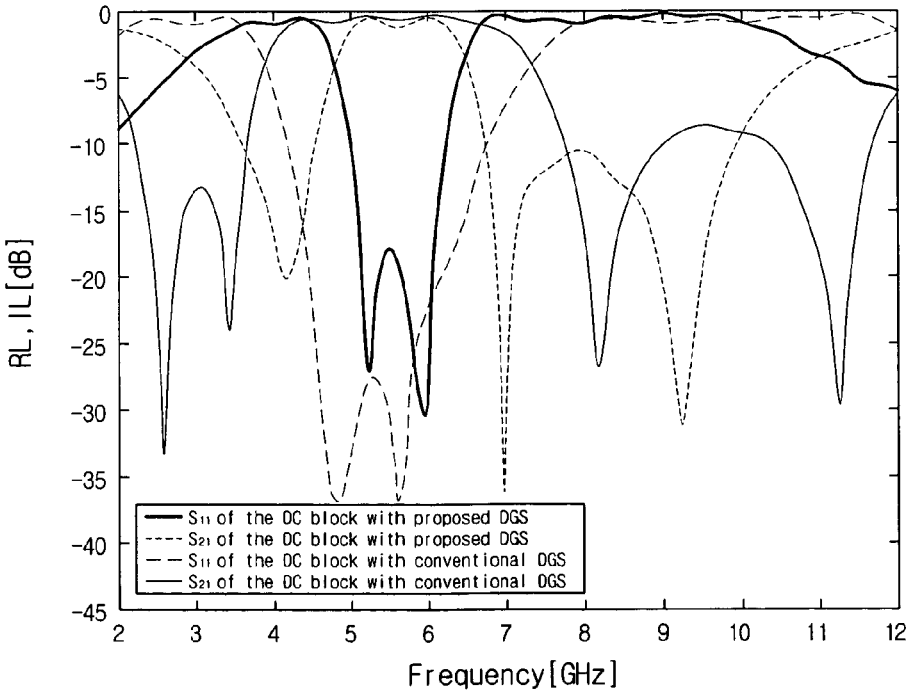
FIG. 4 is a graph showing features of $S_{11}$ and $S_{21}$ of a DC block with the DGS of FIG. 2 and a DC block with a conventional DGS.

FIG. 4 is a graph showing features of $S_{11}$ and $S_{21}$ of a DC block with the DGS 20 of FIG. 3 and a DC block with a conventional DGS. This graph shows features of $S_{11}$ and $S_{21}$ when the components in the coupled lines 10 for DC block of FIG. 1 and the DGSs 20 of FIG. 2 have the following exemplary sizes.

A thickness of the dielectric 5 is 0.600 mm, a dielectric constant $\in_r$ is 4.5, a width $W_{md}$ of the signal line 15 is 1.130 mm, a width $W_{fd}$ of each coupled line 10 is 0.300 mm, a length $L_{fd1}$ of each coupled line 10 is 5.895 mm, a distance $L_{fd2}$ between each coupled line 10 and each signal line 15 is 0.705 mm, and a distance $g_{fd}$ between both coupled lines 10 is 0.150 mm. A length $W_{sd}$ of the etched region 21 of each DGS 20 is 5.650 mm, a width $L_{sd2}$ of the metal region 25 is 0.730 mm, a width $W_{sd2}$ of the bridge 23 is 0.150 mm, a width $L_{sd1}$ of the etched region 21 with the bridge 23 is 0.730 mm, and a width $g_{sd}$ of the remaining etched region 21 is 0.150 mm. Here, the distance $g_{fd}$ between both coupled lines 10 is the same as the width $W_{sd2}$ of the bridge 23.

As shown in FIG. 4, in the case of $S_{11}$, the bandwidth of the DC block with the DGS 20 according to an exemplary embodiment of the present invention is narrower than that of the DC block with a conventional DGS. Likewise, in the case of $S_{21}$, the bandwidth of the DC block with the DGS 20 according to an exemplary embodiment of the present invention is narrower than that of the DC block with a conventional DGS. Accordingly, the stop band can be precisely appointed by using the DC block with the DGS 20 according to an exemplary embodiment of the present invention. Especially, in the case of $S_{11}$ of the DC block with the proposed DGS 20, a communications band of a WLAN to obstruct in the UWB communications is notched at 5.15~5.825 GHz. Therefore, the DC block with the proposed DGS 20 can effectively remove WLAN signals in UWB communications.

Figure 5:
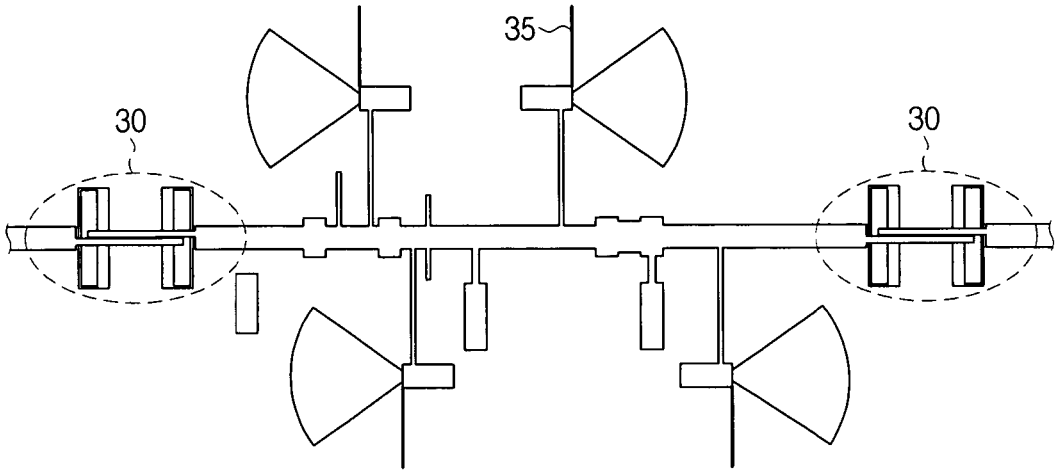
FIG. 5 is a plane view showing an LNA for the UWB with a DC block adopting a DGS according to an exemplary embodiment of the present invention.

FIG. 5 is a plane view showing a low noise amplifier (LNA) for the UWB communications with the DC block adopting the DGS 20 according to an exemplary embodiment of the present invention. As shown in FIG. 5, the LNA for the UWB communications consists of plural elements and is connected with four power lines 35 to receive power supply.

DC blocks 30 with the proposed DGS 20 are formed at opposite ends of the LNA to obstruct DC power between the signal line 15 and the LNA. Additionally, the band can be cut off in the UWB communications by the DGS 20 adopted in the DC block 30.

Figure 6:
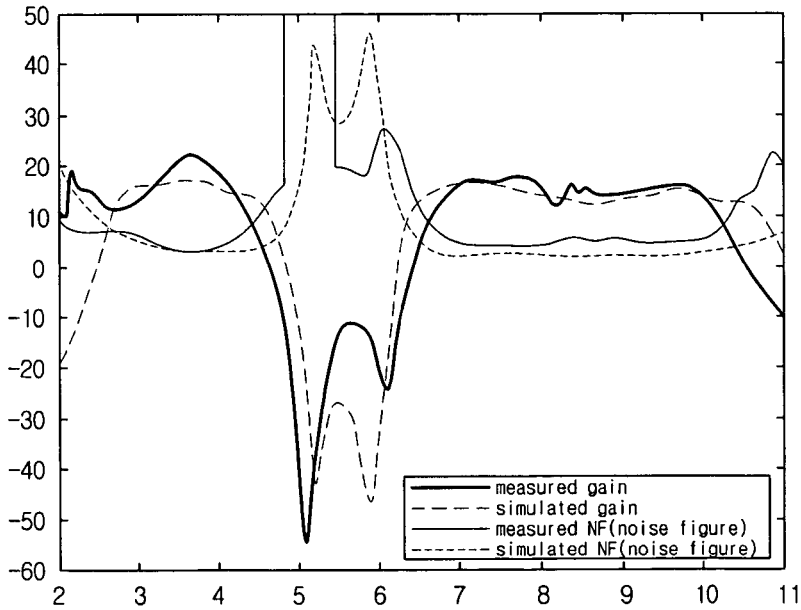
FIG. 6 is a graph showing an exemplary gain and NF of the LNA for the UWB of FIG. 5.

FIG. 6 is a graph showing a gain and NF of the LNA for the UWB of FIG. 5. As shown in FIG. 6, the simulated gain and noise figure (NF) is almost the same as the measured gain and NF. Accordingly, the present invention can practically be applied to the LNA for the UWB.

In addition, FIG. 6 shows that the measured gain is notched by about −30 dB in the WLAN frequency band of 5~6 GHz. It means that the WLAN signal can be blocked by using the LNA for the UWB. Therefore, the BSF is not separately needed.

As described above, the DC block 30 with the DGS 20 forms the stop band in the WLAN band by the DGS 20, so that the BSF is not separately needed in the UWB communications system. Accordingly, the size of the communications system can be reduced and the efficiency can increase.

Further, as the metal region 25 is formed in the etched region 21 of the DGS 20, additional modes occurs in the etched region 21 reduced by the metal region 25 so that it keeps the bandwidth from getting wide, and effective inductance and capacitance are generated so that the stop band can be limited. Furthermore, the length of the etched region 21 effectively lengthens by the metal region 25 so that the size of the DGS 20 can be reduced. As a result, the size of the communications system can decrease.

Furthermore, the stop band and bandwidth can vary by adjusting the width and length of the etched region 21 and metal region 25.

As can be appreciated from the above description, the stop band of the desired bandwidth in the desired communications band can be formed and the size of the communications system can be reduced.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A direct current (DC) block with a band-notch characteristic using a defected ground structure (DGS), the DC block comprising:

first and second coupled lines which are formed parallel to each other on one surface of a dielectric and block a flow of a DC; and at least a first DGS which is formed on an area of another surface of the dielectric corresponding to each coupled line, the first DGS comprising an etched region formed by etching a part of a ground surface bonded to the dielectric and a metal region formed within the etched region.

2. The DC block of claim 1, further comprising a second DGS, wherein the first and second DGSs are formed corresponding to a terminating end of each of the first and second coupled lines, and each of the first and second DGSs is elongated across each coupled line.

3. The DC block of claim 2, wherein the etched region is formed along a circumference of the metal region.

4. The DC block of claim 3, wherein each of the first and second DGSs further comprises a bridge of a metal plate which electrically connects the metal region and the ground surface.

5. The DC block of claim 4, wherein the bridge is formed at a longitudinally central part of each of the first and second DGSs.

6. The DC block of claim 5, wherein the bridges of the first and second DGSs are formed in a mirror image of each other so that the both bridges face each other.

7. The DC block of claim 6, wherein the bridge of each of the first and second DGSs is located in area corresponding to where the first and second coupled lines are adjacent to each other.

8. The DC block of claim 7, wherein a distance between the first and second coupled lines is equal to a width of the bridge.

9. The DC block of claim 8, wherein a length of the etched region along the circumference of the metal region except for the bridge is $\lambda/2$ of a frequency of a stop band.

10. The DC block of claim 9, wherein the etched region has one of a rectangular shape, a square shape, an oval shape, a round shape, a diamond shape, a zigzag shape and a spiral shape.

11. The DC block of claim 10, wherein the metal region is formed in the same shape as the etched region.

12. The DC block of claim 11, wherein the width and length of the etched region and the metal region are set based on the stop band and the bandwidth.

13. The DC block of claim 12, wherein the metal region is closer to a first longitudinal side of the etched region than to a second longitudinal side of the etched region.

* * * * *